US008948622B2

(12) United States Patent
Nishikawa

(10) Patent No.: US 8,948,622 B2
(45) Date of Patent: Feb. 3, 2015

(54) SELF-MONITORING IMAGE FORMING APPARATUS

(75) Inventor: Shingo Nishikawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 353 days.

(21) Appl. No.: 13/460,782

(22) Filed: Apr. 30, 2012

(65) Prior Publication Data

US 2012/0294634 A1 Nov. 22, 2012

(30) Foreign Application Priority Data

May 18, 2011 (JP) ..... 2011-111074

(51) Int. Cl.
*G03G 15/08* (2006.01)

(52) U.S. Cl.
USPC ..... 399/27

(58) Field of Classification Search
CPC ..... G03G 15/0824; G03G 15/0831; G03G 15/553; G03G 15/556; G03G 2215/0888
USPC ..... 399/27, 30, 258, 262, 16
See application file for complete search history.

(56) References Cited

U.S. PATENT DOCUMENTS 5,790,917 A * 8/1998 Takura et al. ..... 399/27
7,206,528 B2 * 4/2007 Matsunai ..... 399/43
7,224,914 B2 * 5/2007 Ushiroji et al. ..... 399/27
7,620,334 B2 * 11/2009 Shimizu ..... 399/30
8,682,184 B2 * 3/2014 Nishikawa ..... 399/27

FOREIGN PATENT DOCUMENTS

JP 06208263 A * 7/1994
JP 2000-162925 A 6/2000
JP 2003114567 A * 4/2003
JP 2012247699 A * 12/2012

* cited by examiner

*Primary Examiner* — Robert Beatty
(74) *Attorney, Agent, or Firm* — NDQ&M Watchstone LLP

(57) ABSTRACT

An image forming apparatus includes an image forming section including a developing section, a toner container mountable to and removable from the image forming apparatus, an intermediate hopper for replenishing toner supplied from the toner container to the developing section, a toner remaining amount detection sensor for detecting a remaining amount of the toner in the intermediate hopper, a cover to be opened and closed when the toner container is mounted and removed, an opening/closing detection sensor for detecting an operation of opening and closing the openable and closable cover, and a main control section. During a print job, the main control section continues image formation when the cover is opened and an amount of the toner is less than a predetermined amount. Further, the main control section halts the image formation when the cover is opened and the amount of the toner is the predetermined amount or more.

1 Claim, 4 Drawing Sheets

SELF-MONITORING IMAGE FORMING APPARATUS

This application is based upon and claims the benefit of priority from the corresponding Japanese Patent Application No. 2011-111074 filed on May 18, 2011, the entire contents of which are incorporated herein by reference.

FIELD

The present disclosure relates to an image forming apparatus such as a copying machine, a printer, and a facsimile machine.

BACKGROUND

An electrophotographic image forming apparatus such as a copying machine and a printer widely employs a photosensitive drum as an image bearing member. A general image forming operation using the photosensitive drum is carried out in the following manner. A charging section uniformly charges a surface of the photosensitive drum at a predetermined potential. An exposure section irradiates the surface of the photosensitive drum with LED light or the like, and the surface potential optically attenuates in part, to thereby form an electrostatic latent image corresponding to a desired image. A developing section develops the electrostatic latent image to form a toner image on the surface of the photosensitive drum. The toner image is transferred to a paper sheet when the paper sheet passes through a transferring region formed by the photosensitive drum and a transferring member, which are held in contact with or proximity to each other.

In order to achieve smooth image formation, it is necessary to appropriately grasp and notify a user of a remaining amount of toner as developer stored in the developing section that plays a major role in the image forming operation as described above. The user needs to replenish the toner to the image forming apparatus based on information on the remaining amount of the toner. In view of this, there is an image forming apparatus in which a toner container or a toner cartridge easily replaceable by the user is removably provided to a main body of the image forming apparatus.

The above-mentioned image forming apparatus includes a toner cartridge mountable to and removable from the main body of the image forming apparatus, a hopper serving as a toner buffer for temporarily storing toner supplied from the toner cartridge and replenishing the toner to the developing section, and detection means for detecting mounting and removal of the toner cartridge. With the hopper provided in the image forming apparatus, even when the removal of the toner cartridge is detected, the print job is continued and the user is prompted to mount the toner cartridge. In a case where a cover to be opened and closed when the toner cartridge is mounted and removed is opened, the image forming apparatus prompts the user to close the cover.

However, in the above-mentioned image forming apparatus, when the print job is continued in the case where the removal of the toner cartridge is detected, the remaining amount of toner replenished to the developing section from the toner cartridge is not taken into consideration.

That is, when it is detected that the toner cartridge is removed or the cover is opened under a state in which the toner is used up or almost used up, the toner cartridge is likely to be replaced with a new toner cartridge in a relatively early stage after the detection, which hardly disturbs continuation of the print job. On the other hand, when it is detected that the toner cartridge is removed or the cover is opened under a state in which the toner is sufficiently loaded, some trouble may occur in the image forming apparatus and the user may be unaware of the trouble. As a result, for example, the replenishment of the toner to the developing section is not smoothly performed so that the image quality is lowered, and an unnecessary replenishing operation is repeated even though the toner does not need to be replenished to the developing section so that the operation efficiency is lowered. Therefore, there is a risk that the continuation of the print job is seriously disturbed in the above-mentioned state.

SUMMARY

The present disclosure has been made in view of the above-mentioned matters, and has an object to provide an image forming apparatus capable of correctly determining a normal/abnormal state of the image forming apparatus in relation to opening of an openable and closable cover during execution of a print job, which is to be opened and closed when a toner container is mounted to and removed from a main body of the image forming apparatus, to thereby appropriately control an image forming operation in accordance with the normal/abnormal state. Further, the present disclosure has an object to provide an image forming apparatus capable of obtaining an image with suitable quality and having improved operation efficiency as a result of the control.

In order to achieve the above-mentioned objects, an image forming apparatus according to an exemplary embodiment of the present disclosure includes an image forming section, a toner container, an intermediate hopper, a remaining amount detection sensor, an openable and closable cover, an opening/closing detection sensor, and a control section. The image forming section includes a developing section for developing an electrostatic latent image formed on a surface of an image bearing member into a toner image through supply of toner to the image bearing member. The image forming section is configured to execute image formation for transferring an image onto a paper sheet. The toner container stores the toner, and is mountable to and removable from a main body of the image forming apparatus. The intermediate hopper stores the toner supplied from the toner container to replenish the toner to the developing section. The remaining amount detection sensor detects a remaining amount of the toner in the intermediate hopper. The openable and closable cover is to be opened and closed when the toner container is mounted to and removed from the main body of the image forming apparatus. The opening/closing detection sensor detects an operation of opening and closing the openable and closable cover. The control section is configured to acquire output from each of the remaining amount detection sensor and the opening/closing detection sensor, and control the image formation executed by the image forming section. During execution of a print job, the control section is configured to cause the image forming section to continue the image formation for the print job that is being executed, when the control section recognizes based on the output acquired from the opening/closing detection sensor that the openable and closable cover is opened, and when the control section recognizes based on the output acquired from the remaining amount detection sensor that an amount of the toner in the intermediate hopper is less than a predetermined amount. Further, the control section is configured to cause the image forming section to halt the image formation for the print job that is being executed, when the control section recognizes based on the output acquired from the opening/closing detection sensor that the openable and closable cover is opened, and when the control section recognizes based on the output acquired from the remaining amount detection sensor that the amount of the toner in the intermediate hopper is the predetermined amount or more.

Further features and advantages of the present disclosure will become apparent from the description of embodiments given below.

DETAILED DESCRIPTION OF EMBODIMENTS

Hereinafter, an embodiment of the present disclosure is described with reference to FIGS. 1 to 4. Note that, elements such as components and arrangements described in the embodiment are not limitations to the scope of the disclosure but merely examples for description thereof.

Figure 1:
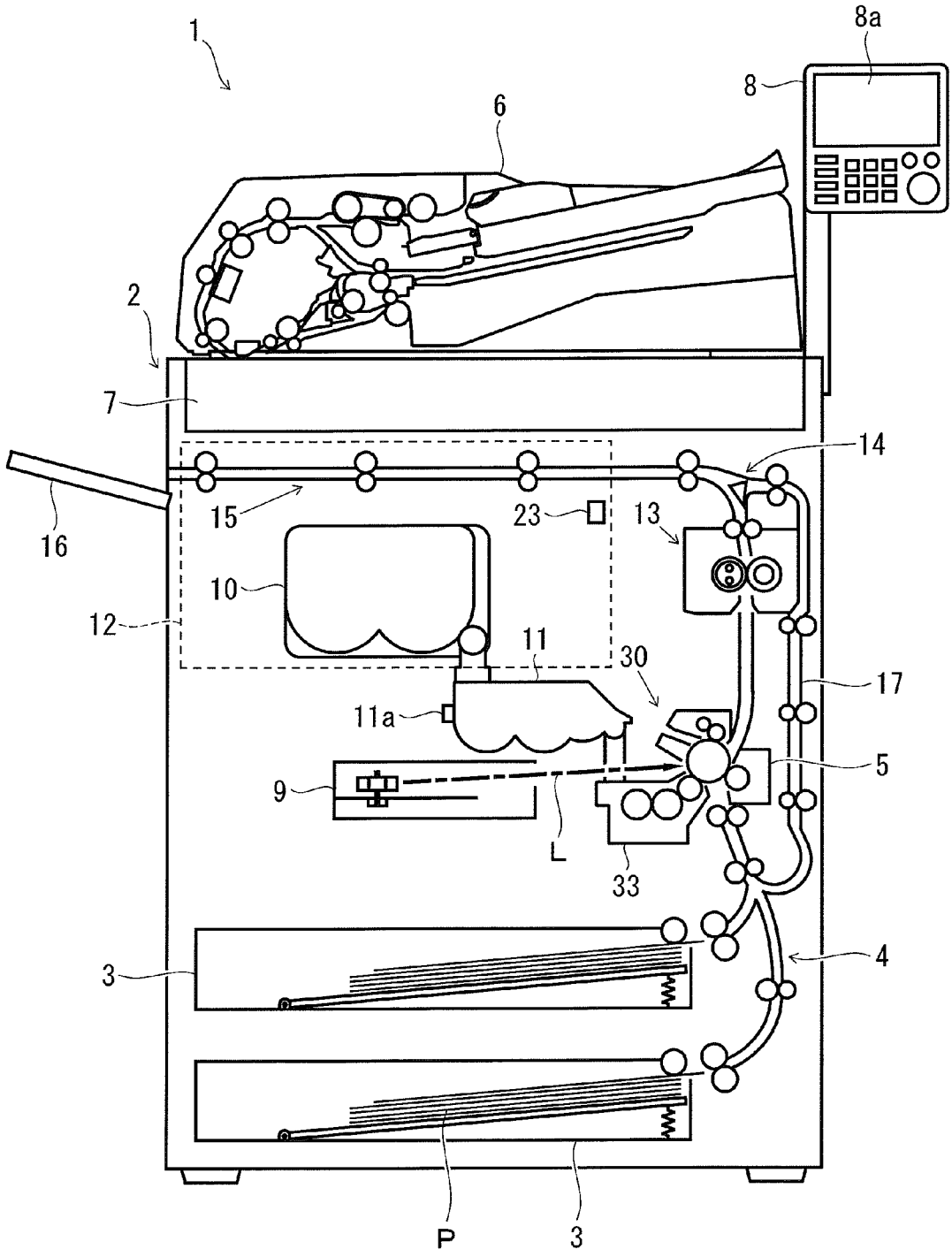
FIG. 1 is a schematic vertically-sectional front view of an image forming apparatus according to an embodiment of the present disclosure.
Figure 2:
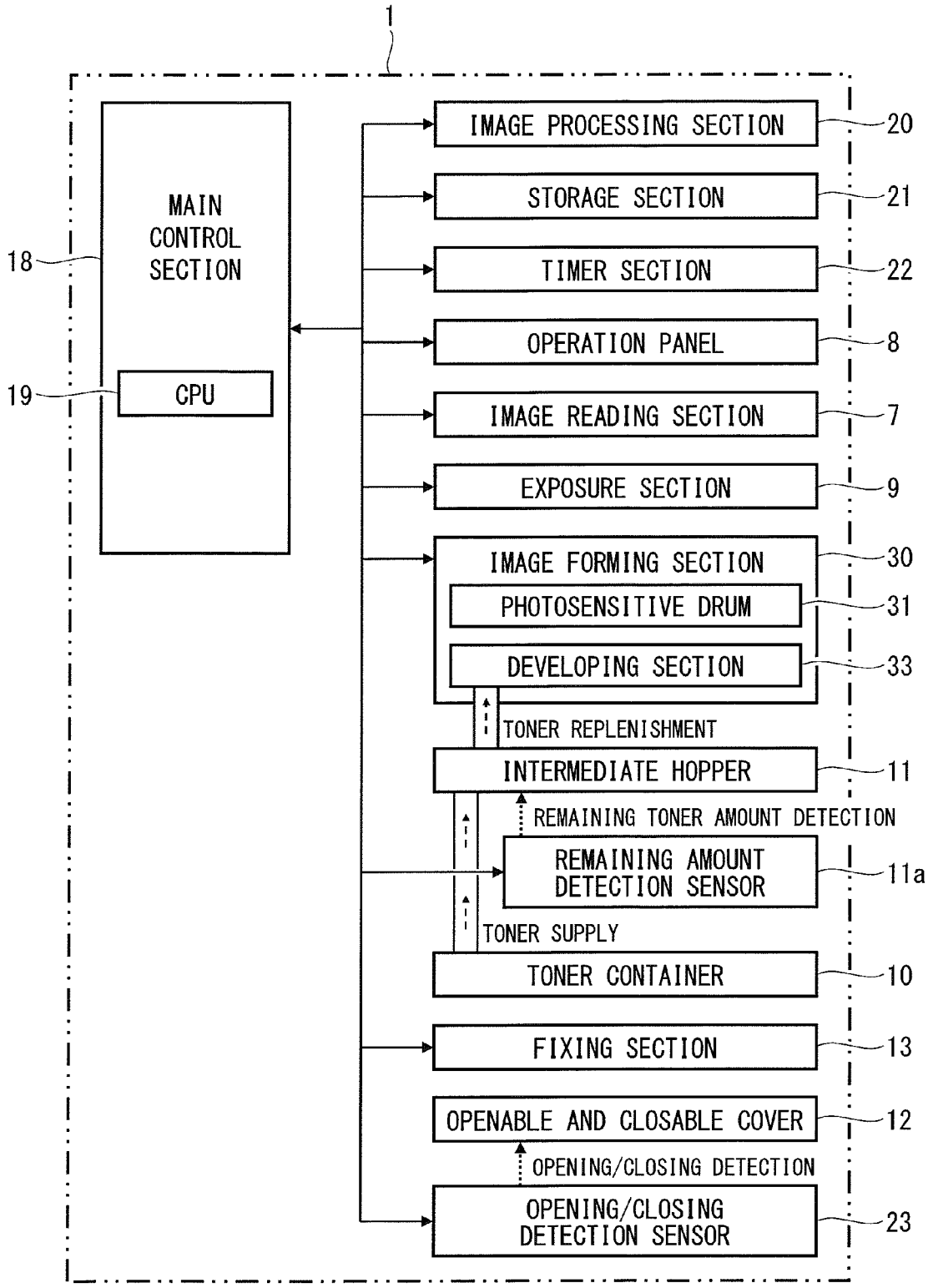
FIG. 2 is a block diagram illustrating a configuration of the image forming apparatus according to the embodiment of the present disclosure.

First, with regard to an image forming apparatus according to the embodiment of the present disclosure, an image output operation is described by referring to FIGS. 1 and 2 while describing an outline structure and configuration thereof. FIG. 1 is a schematic vertically-sectional front view of the image forming apparatus, and FIG. 2 is a block diagram illustrating the configuration of the image forming apparatus. In FIG. 1, the chain line arrow indicates a laser beam L.

As illustrated in FIG. 1, an image forming apparatus 1 includes a main body 2, inside which sheet feeding cassettes 3 are arranged on a lower side thereof. The sheet feeding cassette 3 stores therein a bundle of paper sheets P as recording media, such as cut sheets to be subjected to printing. The paper sheets P are separately sent out one by one toward a top right side of the sheet feeding cassette 3 of FIG. 1. The sheet feeding cassette 3 can be pulled out horizontally from a front surface side of the main body 2.

A first sheet transporting section 4 is provided inside the main body 2 on a right side of the sheet feeding cassette 3. The first sheet transporting section 4 is formed substantially vertically along a right side surface of the main body 2. The first sheet transporting section 4 receives the paper sheet P sent out from the sheet feeding cassette 3, and transports the paper sheet P to a transferring section 5 vertically upward along the right side surface of the main body 2.

On the other hand, an original transporting device 6 is mounted above the main body 2 of the image forming apparatus 1, and an image reading section 7 is mounted inside the main body 2 below the original transporting device 6. When a user performs copying of an original, originals on which images of characters, graphics, patterns, and the like are drawn are stacked on the original transporting device 6, or each original is placed on a contact glass (not shown) on an upper surface of the image reading section 7. The original transporting device 6 separately sends out the originals one by one, and the image reading section 7 reads an image of each original. The image reading section 7 reads an image of the original placed on the contact glass through scanning of light performed inside the image reading section 7.

The start of reading of the original image and printing is instructed with use of an operation panel 8 provided on an upper right side of the image forming apparatus 1. The operation panel 8 is provided so as to project upward from the main body 2. Further, the operation panel 8 serves as an operation section for receiving settings performed by the user on printing conditions, such as a type and size of the paper sheet P to be used for printing, resizing, and a setting on duplex printing, and for receiving instructions to indicate an error state and to cancel the indication. The operation panel 8 serves also as a notification section for notifying the user of, for example, a state of the image forming apparatus, notices, and error messages which are displayed on a display section 8*a*.

Information on image data on the original is subjected to image processing via a main control section and an image processing section to be described later, and is then sent to an exposure section 9 arranged above the sheet feeding cassette 3 at a center part of the main body 2. The exposure section 9 irradiates an image forming section 30 with the laser beam L controlled based on the image data.

The image forming section 30 and the transferring section 5 are provided above the first sheet transporting section 4 on a right side of the exposure section 9. In the image forming section 30, an electrostatic latent image corresponding to the original image is formed by the laser beam L irradiated by the exposure section 9, and a toner image is developed from the electrostatic latent image. Toner is supplied from a toner container 10 provided at an upper part of the main body 2 to an intermediate hopper 11 provided below the toner container 10 and above the exposure section 9. The toner is replenished to the image forming section 30 from the intermediate hopper 11. The toner image formed by the image forming section 30 is transferred by the transferring section 5 onto the paper sheet P before printing, which is sent by the first sheet transporting section 4 in synchronization with the formation of the toner image.

The toner container 10 is mountable to and removable from the main body 2. For the mounting and removal of the toner container 10, an openable and closable cover 12 is provided in the front surface of the main body 2. The toner container 10 is mountable to and removable from the main body 2 through an opening appearing when the openable and closable cover 12 is opened toward the front side.

A fixing section 13 is provided above the transferring section 5 and the image forming section 30. The paper sheet P having an unfixed toner image borne at the transferring section 5 is sent to the fixing section 13, and a heat roller and a pressure roller heat and pressurize the toner image so that the toner image is fixed to the paper sheet P.

A branch section 14 is provided above the fixing section 13. When the duplex printing is not performed, the paper sheet P discharged from the fixing section 13 is transported from the branch section 14 through a second sheet transporting section 15 extending substantially horizontally toward a left side surface of the main body 2, and is discharged to a sheet discharge section 16 provided outside the main body 2 at the upper part of the left side surface of the main body 2.

When the duplex printing is performed, the paper sheet P discharged from the fixing section 13 is temporarily sent out from the branch section 14 toward the sheet discharge section 16, and then the transportation direction of the paper sheet P is immediately switched in the second sheet transporting section 15 to a direction toward the right side surface of the main body 2. Then, the paper sheet P passes through the branch section 14, and is sent downward through a sheet transportation path 17 for duplex printing, which is provided on a right side of the fixing section 13 and the transferring section 5. The paper sheet P is again sent to the transferring section 5 via the first sheet transporting section 4.

As illustrated in FIG. 2, for operation control of the entire image forming apparatus 1, the image forming apparatus 1 further includes, inside the main body 2 thereof, a main control section 18 formed of a central processing unit (CPU) 19 and other such electronic components (not shown). The main control section 18 uses the CPU 19 and an image processing section 20 to implement a series of image forming operations by controlling the components such as the image reading section 7, the exposure section 9, the image forming section 30, and the fixing section 13 based on a program and data stored in and input to a storage section 21. The image forming apparatus 1 further includes a timer section 22 for measuring time, to thereby grasp various kinds of time necessary for the image forming operation.

An opening/closing detection sensor 23 is provided at a location corresponding to the location of the openable and closable cover 12. For example, the opening/closing detection sensor 23 is constructed with use of a transmissive optical sensor provided to the main body 2 and a blocking plate provided to the openable and closable cover 12, for blocking light from the optical sensor under a closed state of the openable and closable cover 12. The blocking plate moves along with an operation of opening and closing the openable and closable cover 12, and accordingly the level of a signal output from the optical sensor is switched. In response to the output from the opening/closing detection sensor 23, the main control section 18 detects the opened state or the closed state of the openable and closable cover 12.

Figure 3:
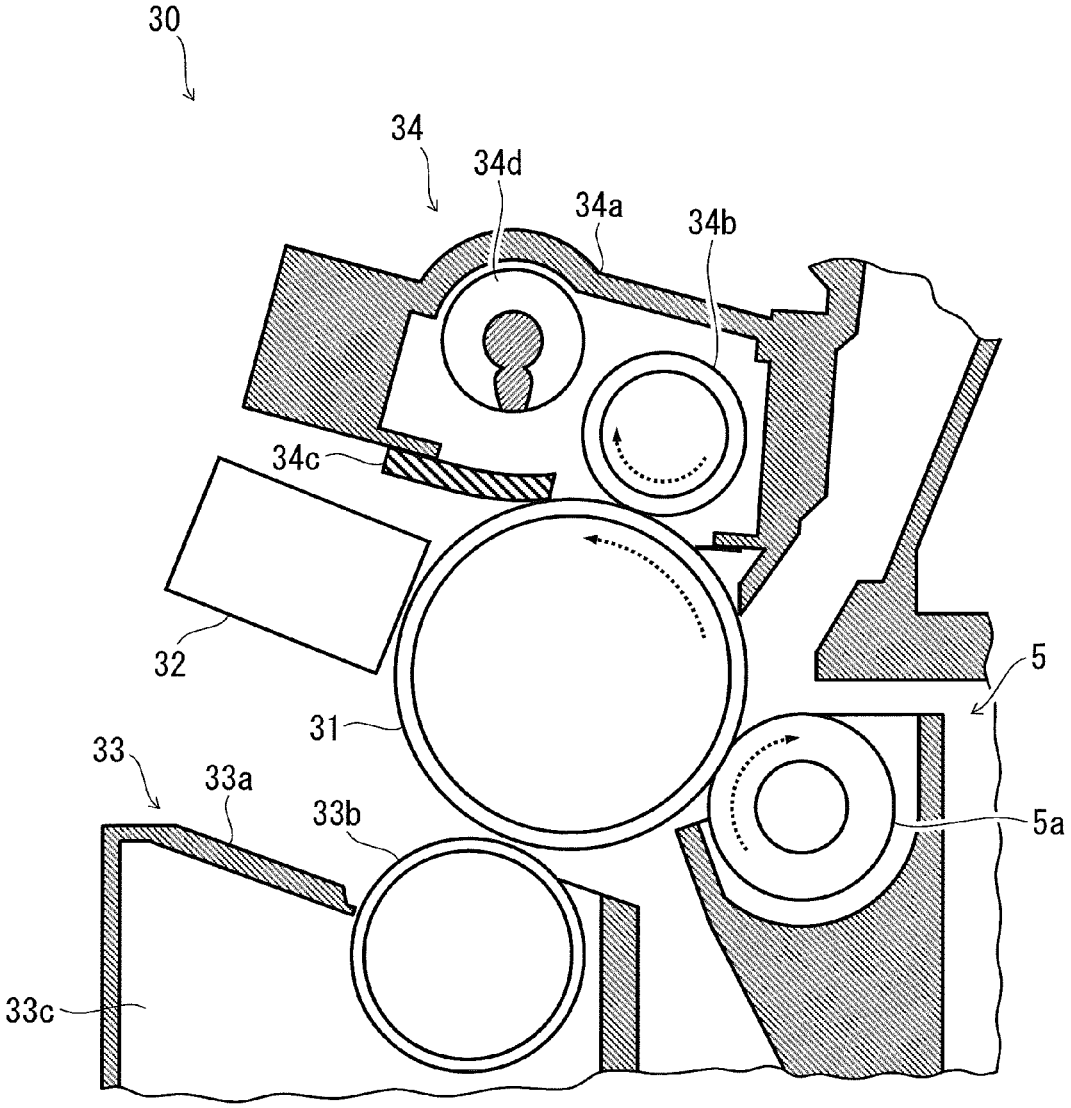
FIG. 3 is a vertically-sectional partial front view illustrating an image forming section and its vicinity in the image forming apparatus according to the embodiment of the present disclosure.

Next, in addition to FIGS. 1 and 2, reference is made to FIG. 3 to describe the detailed configuration of the image forming section 30 and its vicinity. FIG. 3 is a vertically-sectional partial front view illustrating the image forming section and its vicinity.

As illustrated in FIG. 3, the image forming section 30 includes a photosensitive drum 31 serving as an image bearing member at the center thereof. In the vicinity of the photosensitive drum 31, a charging section 32, a developing section 33, and a cleaning section 34 are arranged in the stated order along a rotational direction of the photosensitive drum 31. The transferring section 5 is provided between the developing section 33 and the cleaning section 34 along the rotational direction of the photosensitive drum 31.

The photosensitive drum 31 extends in a sheet width direction orthogonal to the sheet transportation direction in the image forming apparatus 1, that is, in a depth direction of the drawing sheet of FIG. 3. The photosensitive drum 31 is arranged with its axial direction kept horizontal. The photosensitive drum 31 is an inorganic photoreceptor drum, in which a photosensitive layer made of amorphous silicon as an inorganic photoconductive material is provided by vacuum deposition or the like on an outer side of a conductive roller-like base material made of aluminum or the like. For example, the photosensitive drum 31 has a diameter of 30 mm. The photosensitive drum 31 rotates counterclockwise in FIG. 3 by a drive section (not shown) so that a circumferential speed thereof substantially equals the sheet transportation speed (for example, 230 mm/sec).

The charging section 32 is a scorotron charging device using a corona charger, which is arranged on a substantially left side of the photosensitive drum 31. Note that, the charging section 32 may be a corotron charging device similarly using a corona charger, or a contact charging device such as a charging roller and a charging brush. The charging section 32 uniformly charges a surface of the photosensitive drum 31 at a predetermined polarity and potential. At this time, the charging potential is generally +350 V, for example.

The developing section 33 is arranged below the photosensitive drum 31, and includes a developing roller **33*b* inside a housing 33*a* thereof. The development method using the developing roller 33*b* involves, for example, magnetic toner projection development, and the developing roller 33*b* is provided in the vicinity of the photosensitive drum 31. A developing bias having the same polarity as the charging polarity of the photosensitive drum 31 is applied to the developing roller 33*b*. The developing roller 33*b* charges toner as developer, and moves and supplies the toner to the electrostatic latent image formed on the surface of the photosensitive drum 31**, to thereby develop the electrostatic latent image.

The toner is, for example, styrene acrylic magnetic single component toner, and is stored in the toner container 10 illustrated in FIG. 1. The toner is transported by a toner transporting mechanism (not shown) to the developing section 33 via the intermediate hopper 11, and is replenished to a toner storage chamber **33*c* provided inside the housing 33*a* of the developing section 33. Note that, the development method and the kind of toner applied to the developing section 33** are not limited to the above.

The transferring section 5 is arranged on a substantially right side of the photosensitive drum 31, and includes a transferring roller **5*a*. The transferring roller 5*a* is held in press contact with the photosensitive drum 31 from the right side of FIG. 3, and forms a transfer nip portion, through which the paper sheet P passes, between the transferring roller 5*a* and the photosensitive drum 31. The transferring roller 5*a* is held in contact with the photosensitive drum 31 to rotate without a drive device in accordance with the rotation of the photosensitive drum 31. A transfer bias of, for example, −500 V to −1,000 V having a polarity different from the charging polarity of the photosensitive drum 31 and the toner is applied to the transferring roller 5*a*** as necessary.

The cleaning section 34 is arranged above the photosensitive drum 31, and includes, inside a housing **34*a* thereof, a cleaning roller 34*b*, a cleaning blade 34*c*, and a toner discharge screw 34*d*. The cleaning roller 34*b* and the cleaning blade 34*c* are held in press contact with the photosensitive drum 31, and clean the photosensitive drum 31 by removing adherents such as toner remaining on the surface of the photosensitive drum 31. The toner or the like removed from the surface of the photosensitive drum 31 is sent toward the toner discharge screw 34*d*, and is discharged by the toner discharge screw 34*d* to a waste toner collecting container (not shown) provided outside the cleaning section 34**.

As illustrated in FIGS. 1 and 2, the intermediate hopper 11 for replenishing toner to the toner storage chamber **33*c* of the developing section 33 is provided with a remaining amount detection sensor 11*a* for detecting a remaining amount of the toner in the intermediate hopper 11. For example, the remaining amount detection sensor 11*a* is constructed with use of a transmissive optical sensor. When at least a predetermined amount of toner is present in the intermediate hopper 11, light from the optical sensor is blocked so that the level of a signal output from the optical sensor is switched. In response to the output from the remaining amount detection sensor 11*a*, the main control section 18 detects that the intermediate hopper 11** is filled with at least the predetermined amount of toner, that is, the amount of the toner suffices to continue the image forming operation.

Note that, based on the output acquired from the remaining amount detection sensor **11*a*, when the amount of the toner in the intermediate hopper 11 is less than the predetermined amount, that is, under a state in which the toner is not supplied from the toner container 10, the main control section 18 recognizes that the toner container 10 is in a toner used-up state. When the toner container 10 is in the toner used-up state, the main control section 18 uses the display section 8***a* of the operation panel 8 serving as the notification section to notify the user of the toner used-up state, and prompts the user to replace the toner container 10.

When the toner container 10 is replaced, it is necessary to open the openable and closable cover 12 provided in the front surface of the main body 2. The main control section 18 correctly determines a normal/abnormal state of the image forming apparatus in relation to the opening of the openable and closable cover 12 during execution of a print job, to thereby appropriately control the image forming operation in accordance with the normal/abnormal state.

Figure 4:
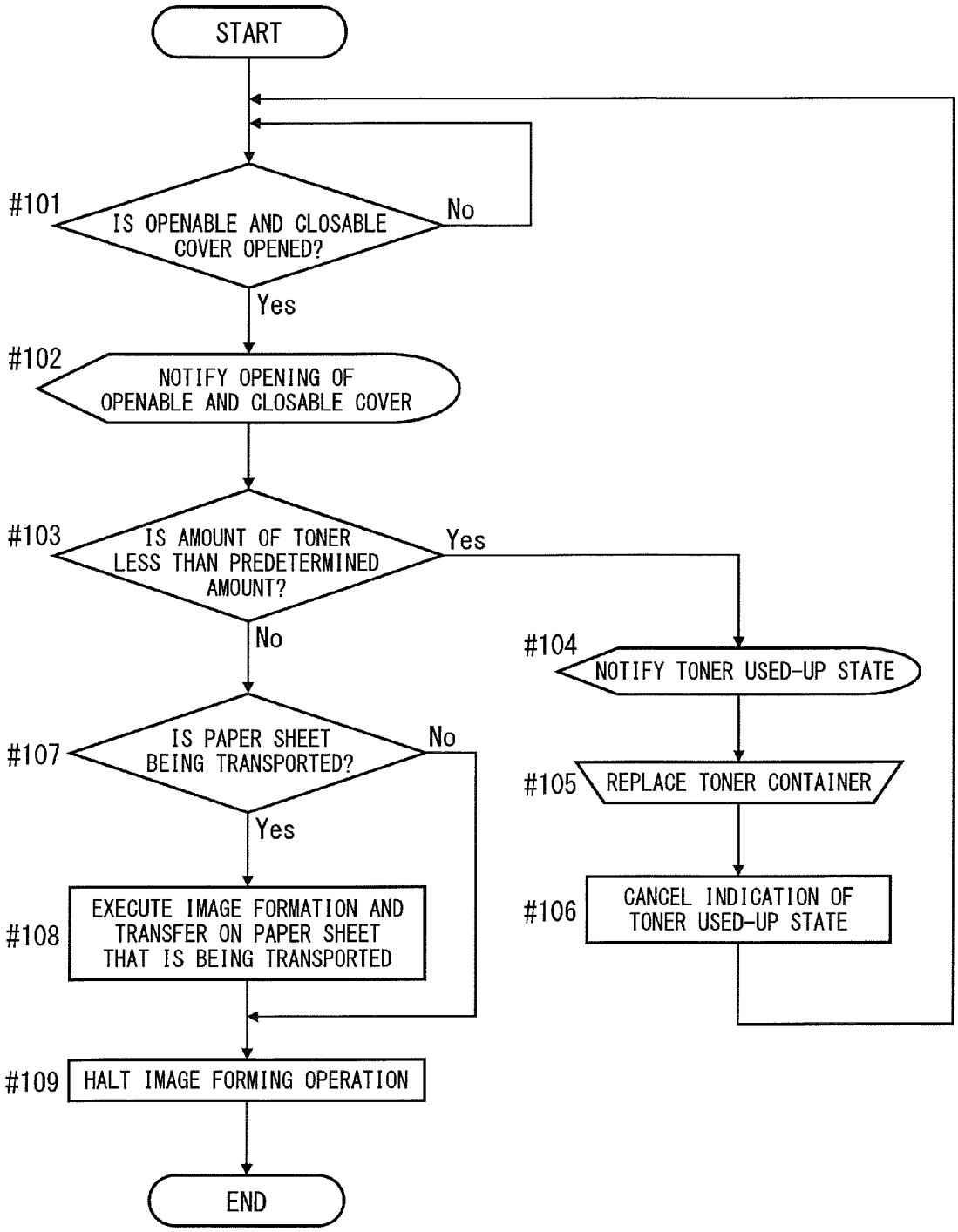
FIG. 4 is a flow chart illustrating an operation in relation to opening of an openable and closable cover during execution of a print job in the image forming apparatus according to the embodiment of the present disclosure.

Next, an operation in relation to the opening of the openable and closable cover 12 during execution of the print job in the image forming apparatus 1 is described with reference to a flow illustrated in FIG. 4. FIG. 4 is a flow chart illustrating the operation in relation to the opening of the openable and closable cover 12 during execution of the print job.

When the print job is executed in the image forming apparatus 1 ("START"), the main control section 18 determines based on the output acquired from the opening/closing detection sensor 23 whether or not the openable and closable cover 12 is in the opened state (Step #101). When the main control section 18 recognizes that the openable and closable cover 12 is in the closed state ("No" in Step #101), the main control section 18 causes the image forming apparatus 1 to normally operate. On the other hand, when the main control section 18 recognizes that the openable and closable cover 12 is in the opened state ("Yes" in Step #101), the main control section 18 causes the display section 8*a* of the operation panel 8 serving as the notification section to display an indication that the openable and closable cover 12 is in the opened state, to thereby notify the user of the opened state of the openable and closable cover 12 (Step #102).

Subsequently, the main control section 18 determines based on the output acquired from the remaining amount detection sensor 11*a* whether or not the amount of the toner in the intermediate hopper 11 is less than the predetermined amount (Step #103). When the main control section 18 recognizes that the amount of the toner in the intermediate hopper 11 is less than the predetermined amount ("Yes" in Step #103), the main control section 18 causes the display section 8*a* of the operation panel 8 to display an indication that the toner container 10 is in the toner used-up state, to thereby notify the user of the toner used-up state of the toner container 10, and prompts the user to replace the toner container 10 (Step #104).

The user notified that the toner in the toner container 10 is used up performs work of replacing the toner container 10 (Step #105). Note that, in Step #105, the user manually replaces the toner container 10. Meanwhile, the main control section 18 causes the image forming section 30 to continue the image formation for the print job that is being executed.

When the user finishes the work of replacing the toner container 10, the main control section 18 recognizes that the amount of the toner in the intermediate hopper 11 has become the predetermined amount or more, and accordingly cancels the determination state in which the toner container 10 is in the toner used-up state (Step #106). Further, the main control section 18 stops the indication displayed on the operation panel 8 for prompting the user to replace the toner container 10. Then, the main control section 18 causes the image forming apparatus 1 to normally operate through the determination that the amount of the toner in the intermediate hopper 11 suffices to continue the image forming operation (returns to Step #101).

On the other hand, when the main control section 18 determines in Step #103 that the amount of the toner in the intermediate hopper 11 is the predetermined amount or more ("No" in Step #103), the main control section 18 determines whether or not the paper sheet P is being transported by the first sheet transporting section 4 toward the transferring section 5 in the current print job (Step #107). When the paper sheet is being transported ("Yes" in Step #107), the main control section 18 causes the image forming section 30 to execute the image formation for the paper sheet P that is being transported, and causes the transferring section 5 to transfer the formed image onto the paper sheet P (Step #108). Then, the main control section 18 prohibits subsequent execution of sheet transportation from the sheet feeding cassette 3.

Subsequently, the main control section 18 halts the image forming section 30 from executing the image formation (Step #109). Then, the main control section 18 ends the flow of operation in relation to the opening of the openable and closable cover 12 during execution of the print job ("END"). That is, the main control section 18 maintains the state of prohibiting the image forming section 30 from executing the image forming operation until the opening/closing detection sensor 23 can detect the closing of the openable and closable cover 12.

As described above, in the case where the amount of the toner in the intermediate hopper 11 is less than the predetermined amount, that is, the toner container 10 is in the toner used-up state when the openable and closable cover 12 is opened during execution of the print job, the main control section 18 of the image forming apparatus 1 determines that the openable and closable cover 12 is normally opened. Then, the main control section 18 causes the image forming section 30 to continue the image formation on the assumption that the toner container 10 is replaced and accordingly the toner is newly replenished. Thus, the image forming apparatus 1 can smoothly execute the image formation with a sufficient amount of toner, to thereby obtain an image with suitable quality.

On the other hand, in the case where the amount of the toner in the intermediate hopper 11 is the predetermined amount or more when the openable and closable cover 12 is opened during execution of the print job, the main control section 18 of the image forming apparatus 1 determines that the openable and closable cover 12 is opened because of abnormality. Then, the main control section 18 prohibits the image forming section 30 from executing the image formation for the risk that some trouble has occurred in the image forming apparatus. Thus, the image forming apparatus 1 can suppress an unnecessary toner replenishing operation for the developing section 33, for example, to thereby improve operation efficiency.

Note that, even in a case where the openable and closable cover 12 is opened and the main control section 18 recognizes that the amount of the toner in the intermediate hopper 11 is the predetermined amount or more, the main control section 18 of the image forming apparatus 1 allows the image formation to be executed for the paper sheet P that is being transported toward the transferring section 5, and allows the transferring section 5 to transfer the formed image onto the paper sheet P. After that, the main control section 18 halts the image formation. Thus, it is possible to prevent the image forming apparatus 1 from such an incomplete state that the paper sheet P is stopped in the middle of transportation.

Further, the image forming apparatus 1 includes the operation panel 8 serving as the notification section for notifying the user of the opened state of the openable and closable cover 12, and hence the user can promptly recognize the opened state of the openable and closable cover 12. Thus, the user can quickly deal with the trouble caused by the fact that the openable and closable cover 12 is opened even though the amount of the toner in the intermediate hopper 11 is the predetermined amount or more.

The operation panel 8 serves also as the notification section for notifying the user of the event that the main control section 18 recognizes based on the output acquired from the remaining amount detection sensor 11*a* that the amount of the toner in the intermediate hopper 11 is less than the predetermined amount. Accordingly, the user can promptly recognize that the toner container 10 is in the toner used-up state. Thus, the user can quickly replace the toner container 10.

According to the configuration of the above-mentioned embodiment, it is possible to provide the image foaming apparatus 1 capable of correctly determining the normal/abnormal state of the image forming apparatus in relation to the opening of the openable and closable cover 12 during execution of the print job, which is to be opened and closed when the toner container 10 is mounted to and removed from the main body 2 of the image forming apparatus 1, to thereby appropriately control the image forming operation in accordance with the normal/abnormal state. Further, it is possible to provide the image forming apparatus 1 capable of obtaining an image with suitable quality and having improved operation efficiency as a result of the control.

In the above, the embodiment of the present disclosure has been described. However, the scope of the present disclosure is not limited thereto, and the present disclosure may be implemented by being subjected to various modifications without departing from the gist of the present disclosure.

For example, the above-mentioned embodiment has been described by taking, as an example of the image forming apparatus 1, an image forming apparatus for monochrome printing with use of only black toner. However, the image forming apparatus to which the present disclosure is applied is not limited to such an image forming apparatus. The image forming apparatus to which the present disclosure is applied may be a tandem or rotary image forming apparatus for color printing, including an intermediate transfer belt, thereby being capable of forming an image of a plurality of colors overlaid one on top of another.

What is claimed is:

1. An image forming apparatus, comprising:

an image forming section including a developing section for developing an electrostatic latent image formed on a surface of an image bearing member into a toner image through supply of toner to the image bearing member, the image forming section being configured to execute image formation for transferring an image onto a paper sheet;

a sheet transporting section for transporting the paper sheet toward a transferring section for transferring, onto the paper sheet, the image formed by the image forming section;

a toner container for storing the toner, the toner container being mountable to and removable from a main body of the image forming apparatus;

an intermediate hopper for storing the toner supplied from the toner container to replenish the toner to the developing section;

a remaining amount detection sensor for detecting a remaining amount of the toner in the intermediate hopper;

an openable and closable cover to be opened and closed when the toner container is mounted to and removed from the main body of the image forming apparatus;

an opening/closing detection sensor for detecting an operation of opening and closing the openable and closable cover; and a notification section for notifying a user of a state of the image forming apparatus;

a control section configured to acquire output from each of the remaining amount detection sensor and the opening/closing detection sensor, and control the image formation executed by the image forming section, wherein, the control section is configured such that, during execution of a print job, when the control section recognizes based on the output acquired from the remaining amount detection sensor that the amount of the toner in the intermediate hopper is less than the predetermined amount, the control section causes the notification section to notify the user that the amount of the toner in the intermediate hopper is less than the predetermined amount;

when the control section recognizes based on the output acquired from the opening/closing detection sensor that the openable and closable cover is opened, and when the control section recognizes based on the output acquired from the remaining amount detection sensor that an amount of the toner in the intermediate hopper is less than a predetermined amount, the control section causes the image forming section to continue the image formation for the print job that is being executed; and when the control section recognizes based on the output acquired from the opening/closing detection sensor that the openable and closable cover is opened, and when the control section recognizes based on the output acquired from the remaining amount detection sensor that the amount of the toner in the intermediate hopper is the predetermined amount or more, the control section causes the image forming section to halt the image formation for the print job that is being executed, after completion of transfer of the image onto the paper sheet being transported if the paper sheet is being transported by the sheet transporting section toward the transferring section and immediately if the paper sheet not is being transported by the sheet transporting section toward the transferring section.

* * * * *